US005272739A

United States Patent [19]

Ford

[11] Patent Number: 5,272,739

[45] Date of Patent: Dec. 21, 1993

[54] METHOD OF ELIMINATING HEAT EXCHANGER TUBE VIBRATION AND SELF-PRELOADING HEAT EXCHANGER TUBE SUPPORT FOR IMPLEMENTING SAME

[75] Inventor: Daniel E. Ford, Cantonment, Fla.

[73] Assignee: Westinghouse Electric Corp., Pittsburgh, Pa.

[21] Appl. No.: 710,857

[22] Filed: Jun. 6, 1991

[51] Int. Cl.[5] ..... G21C 15/00

[52] U.S. Cl. ..... 376/405

[58] Field of Search ..... 376/404, 405; 165/81, 165/82, 162

[56] References Cited

U.S. PATENT DOCUMENTS

| | | | |
|---|---|---|---|
| 4,256,783 | 3/1981 | Takada et al. | 165/81 |
| 4,336,614 | 6/1982 | Mitchell et al. | 376/405 |
| 4,360,057 | 11/1982 | Koump | 165/82 |
| 4,585,058 | 4/1986 | Pierrey | 165/135 |

*Primary Examiner*—Donald P. Walsh
*Assistant Examiner*—Frederick H. Voss

[57] ABSTRACT

A steam generator with a heat exchanger in which the tube openings of the support plate are oversized relative to the outer diameter of the heat exchanger tubes, to facilitate assembly of the heat exchanger, and in which a positive contact preloading of the heat exchanger tubes in opposite directions is produced, once the steam generator goes to operating temperatures and pressures, by a mounting of the support plates which causes them to pull on the heat exchanger tubes in opposites directions so as to provide a passive, positive supporting of the heat exchanger tubes by the supporting plates which eliminates cross flow induced vibrations during operation, pressures despite the existence of clearance gaps between the heat exchanger tubes and the support plates through which they pass at ambient temperatures and pressures.

17 Claims, 5 Drawing Sheets

METHOD OF ELIMINATING HEAT EXCHANGER TUBE VIBRATION AND SELF-PRELOADING HEAT EXCHANGER TUBE SUPPORT FOR IMPLEMENTING SAME

FIELD OF THE INVENTION

The present invention relates to a method by which vibration of the tubes of the heat exchanger in a nuclear steam generator can be eliminated and to a heat exchanger for a nuclear steam generator which will not be subject to tube vibration.

BACKGROUND OF THE INVENTION

FIGS. 1 and 2 illustrate a typical nuclear steam generator 1. Such nuclear steam generators are formed with a primary side 3 and a secondary side 5 which are hydraulically isolated from each other by a tube sheet 7. The primary side is generally of a bowl-shaped configuration that is subdivided by a divider plate 9 into two halves that are sealed against direct flow from one half to the other. An inlet half 10 (known as an inlet channel head) receives radioactive water that has been circulated through a nuclear reactor via a water inlet 11, and an outlet half 12 (known as an outlet channel head) discharges water from the steam generator 1 back to the nuclear reactor via a water outlet 13, as represented by the arrows in FIG. 2. Between the inlet and outlet halves 10, 12 of the primary side 3, the hot radioactive water is circulated through a heat exchanger 15 of the primary side formed from a bundle of U-shaped heat exchanger tubes 16 that are located within the secondary side 5.

The bundle of U-shaped heat exchanger tubes 16 will typically have approximately 3500 tubes, each of which has a hot leg 17, a cold leg 19 and a U-shaped bend 21 connecting them. Open bottom ends of the hot legs 17 and the cold legs 19 are secured within openings in the tube sheet 7 in a leak-proof manner, so that the open ends of the hot legs 17 communicate with the inlet channel head 10 and the open ends of the cold legs communicate with the outlet channel head. Thus, a U-shaped flow path for the radioactive water through the heat exchanger 15 established.

Within the secondary side, the bundle of heat exchanger tubes 16 are uniformly positioned within a plurality of axially spaced support plates 25. Some of the support plates can be fixed to a central divider plate 27 and to a wrapper 29 that is disposed between the bundle of tubes 16 and the outer shell 31 of the steam generator 1. Conventionally, vertical support for the support plates is provided by a plurality of stay rods and spacer pipes (not shown). To receive the legs 17, 19 of the heat exchanger tubes, each of these support plates 25 is provided with tube openings 33. These openings 33 have a diameter that is slightly larger than the outer diameter of the heat exchanger tubes extending therethrough in order to facilitate assembly. Thus, once assembled, a tube-to-plate clearance gap 35 will exist.

Nonradioactive water is delivered to the cold side of the secondary side 5 via a feed nozzle 36 and a preheater distribution box 37. The nonradioactive water is circulated vertically within the heat exchanger 15 in any of a number of ways. Where axial flow preheating is provided, the plates 25 can be an open-work structure that freely allows a flow of water through them. On the other hand, when cross-flow type preheating is utilized, the plates 25 can be low leakage baffles with flow windows, such as that represented at 38 in FIG. 3B.

At the top of the secondary side 5 of the steam generator 1, a steam drying assembly 39 (FIG. 1) is provided for extracting water from the wet steam that is produced by boiling of the nonradioactive water within the heat exchanger 15. This steam drying assembly 39 includes a primary separator 41 and a secondary separator 43. Dry steam rising above the separator assembly 39 is conducted to a steam turbine (not shown) for driving an electrical generator (also not shown). Water extracted from the steam passing through the steam drying assembly 39 is directed into a downcomer path between the wrapper 29 and the shell 31, through which it can travel down to the bottom of the secondary side 5.

As already mentioned, flow of nonradioactive water within the heat exchanger 15 is vertically oriented. However, whether axial preheating or cross flow preheating is provided, cross flows can act upon the cold legs 19 of the heat exchanger tubes in at least the zone containing the preheater distribution box. Because of the clearance gap 35 existing between the cold legs 19 and the tube openings 33 in the support plates 25, in any areas where significant cross flows exist, undesirable tube vibration and wear can occur. Furthermore, if the zone within which cross flows is created are increased to increase heat exchanger efficiency, this problem will be further exacerbated.

Thus, there is a need for a method and heat exchanger which eliminates wear-producing vibrations between the heat exchanger tubes and the support plate openings without eliminating the oversizing of the support plate tube openings relative to the outer diameter of the heat exchanger tubes which serves to facilitate assembly of the heat exchanger.

SUMMARY OF THE INVENTION

It, therefore, is a primary object of the present invention to provide a method and heat exchanger with which wear-producing vibrations can be eliminated without eliminating the oversizing of the support plate tube openings relative to the outer diameter of the heat exchanger tubes which serves to facilitate assembly of the heat exchanger.

More specifically, it is an object of the present invention to provide a method by which foregoing object is achieved through assembling of the support plates so as to cause the alternate support plates, in flow zones containing significant cross flows, to passively generate a positive contact preloading of the heat exchanger tubes in opposite directions once the steam generator goes to operating temperatures and pressure.

Another object of the present invention is to provide a steam generator with a heat exchanger in which the tube openings of the support plate are oversized relative to the outer diameter of the heat exchanger tubes, to facilitate assembly of the heat exchanger, and in which a positive contact preloading of the heat exchanger tubes in opposite directions is produced, once the steam generator goes to operating temperatures and pressures, by a mounting of the support plates which causes them to pull on the heat exchanger tubes in opposites directions.

These objects and others are obtained in accordance with a preferred embodiment of the present invention in which mounting hook-like brackets for the support plates are attached to the central divider plater and the wrapper. These hook-like mounting brackets are received in mounting slots within the support plates on opposite sides of alternate plates. The heat exchange tubes are disposed through oversized openings in the support plates yet vibration of the tubes in these openings is avoided by the brackets producing oppositely directed pulling forces on alternate plates as the heat exchanger comes up to operating temperatures and pressures, so that the support plates are shifted into positive contact with opposite sides of the heat exchange tubes. Since this results in the heat exchange tubes being alternately preloaded in opposing directions, they no longer are free to vibrate within the tube openings of the support plates.

Various other objects, features and advantages of the present invention will become apparent from the following detailed description when viewed in conjunction with the accompanying drawings.

DETAILED DESCRIPTION OF THE PREFERRED EMBODIMENT

Figure 1:
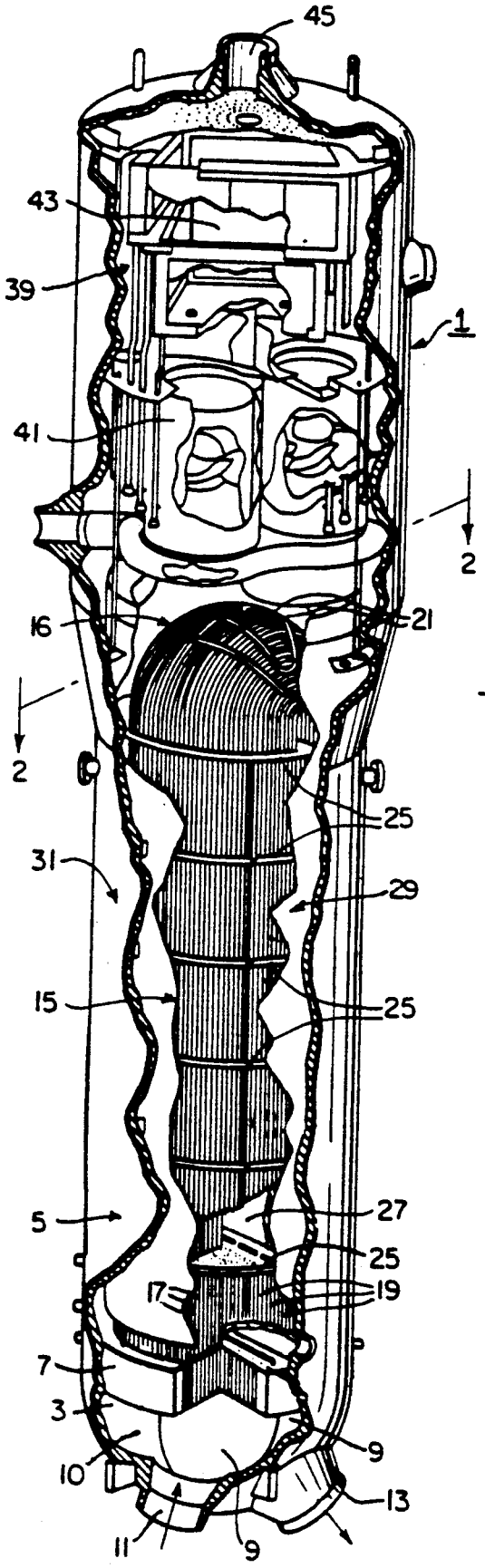
PRIOR ART FIG. 1.
FIG. 1 is a partially broken away perspective view of a conventional Westinghouse-type nuclear steam generator.
Figure 2:
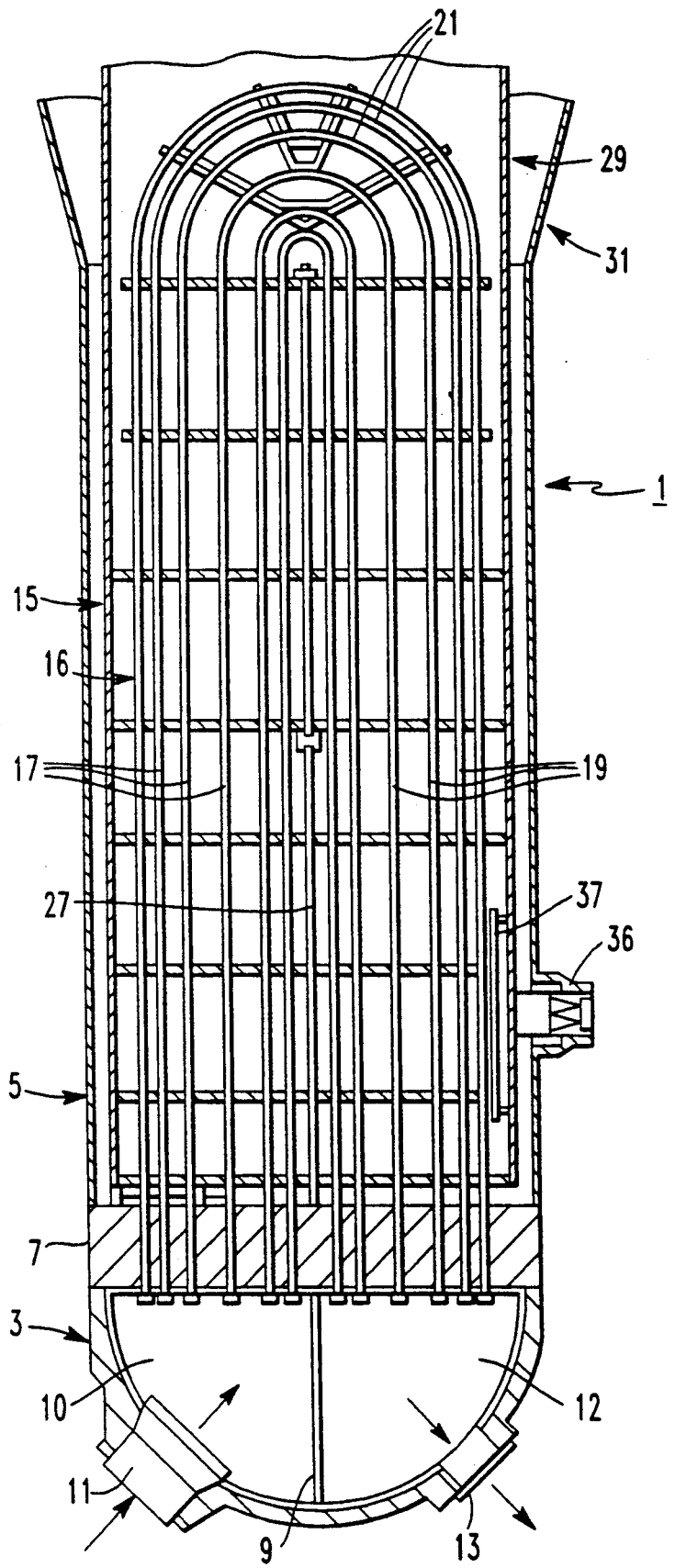
FIG. 2 PRIOR ART
FIG. 2 is a partial cross sectional side view of the steam generator illustrated in FIG. 1 of the portion disposed below line 2—2 and taken along a plane containing the line 2—2.
Figure 4:
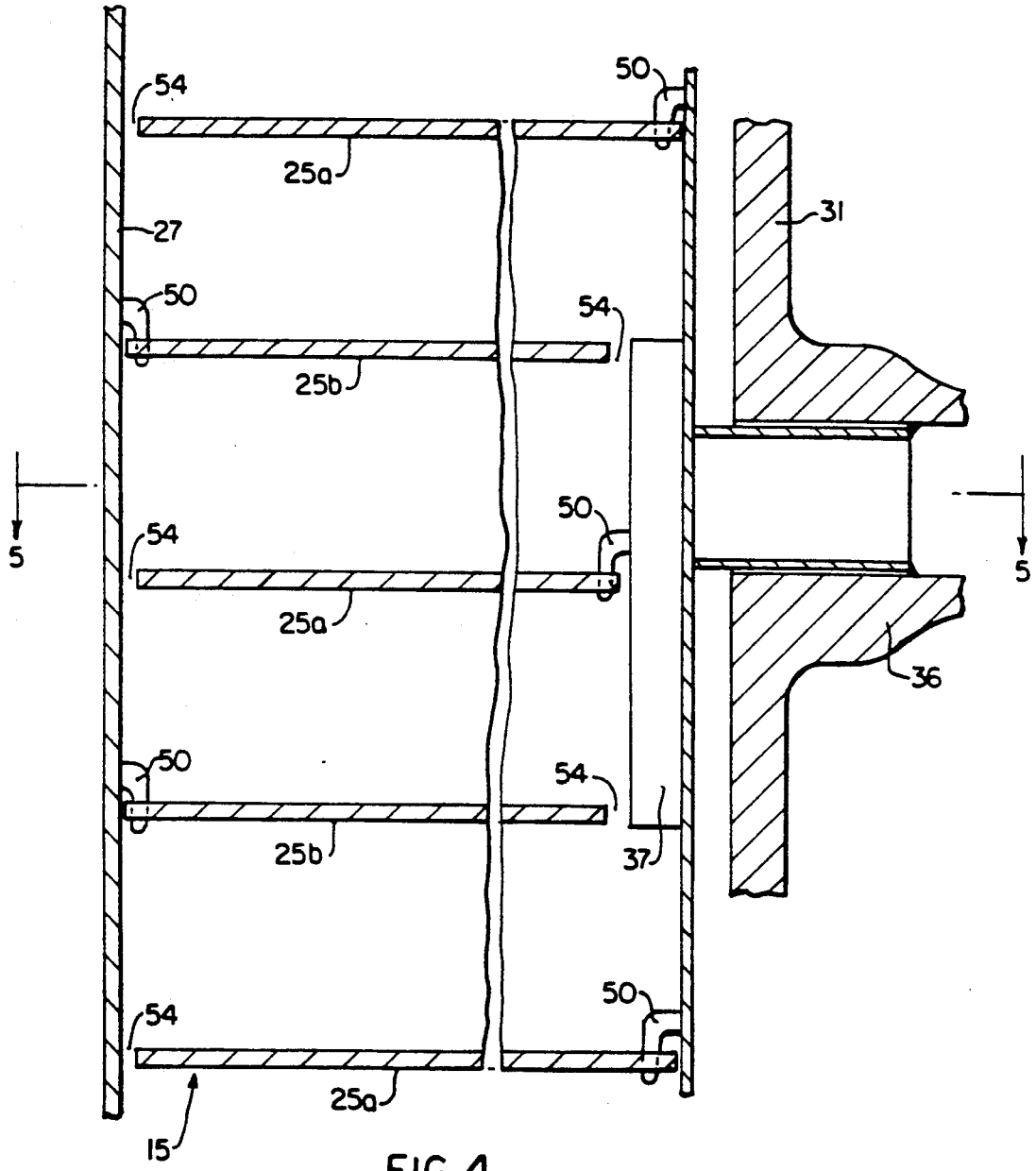
FIG. 4 is a partial cross sectional view of the in-feed zone of a heat exchanger in accordance with the present invention.
Figure 5:
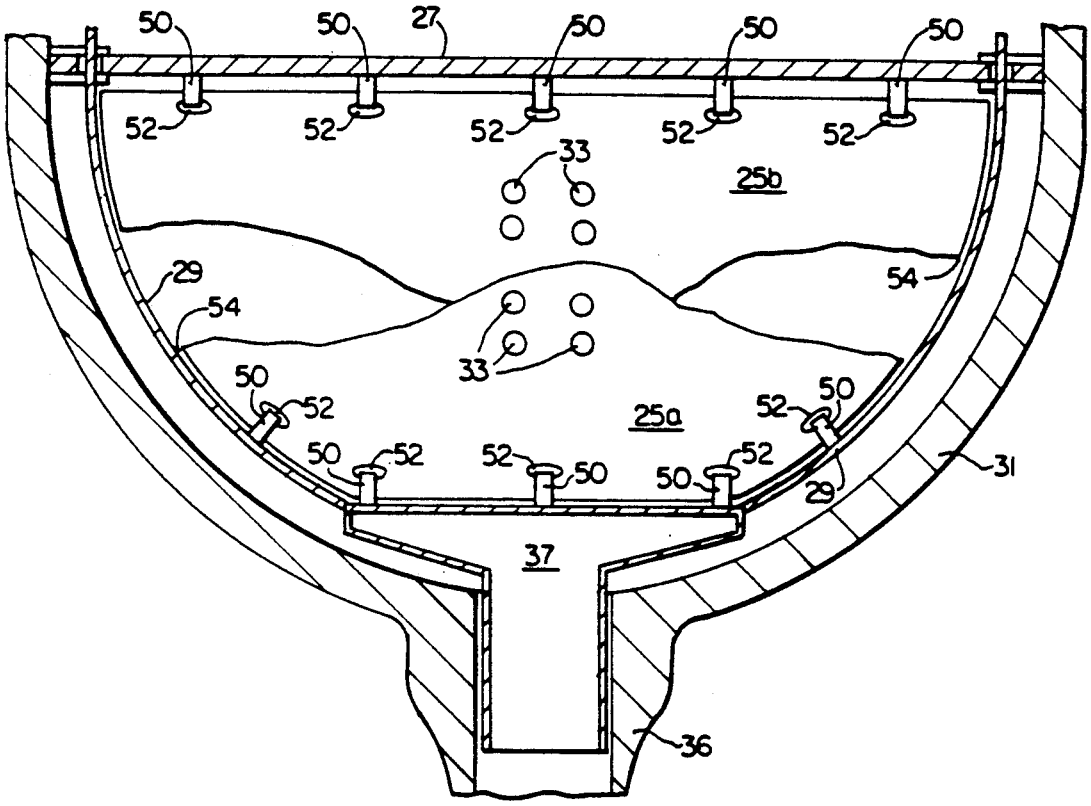
FIG. 5 is a transverse cross sectional view taken along line 5—5 of FIG. 4.

With reference to FIGS. 4 and 5, a preferred embodiment of the apparatus and method in accordance with the present invention will be described relative to its use in a heat exchanger of the type found in a Westinghouse-type nuclear reactor system as described relative to FIGS. 1 and 2, above. However, as will also be made clear, the present invention is by no means limited to the specific environment used as an illustrative example. Furthermore, since, except for the specific zone illustrated in FIGS. 4 and 5, a heat exchanger in accordance with the present invention will be identical in every other respect to any conventional heat exchanger with which it is implemented, the detailed description will be limited to only those aspects which are novel to the present invention. Still further, it should be appreciated that while only a few of the tube openings 33 of the support plates 25 and one cold leg 19 of the bundle of heat exchanger tubes 16 is illustrated in FIGS. 4 and 5, for simplicity, the number and placement of such openings and heat exchanger tubes will conform with conventional practice.

Figure 3A:
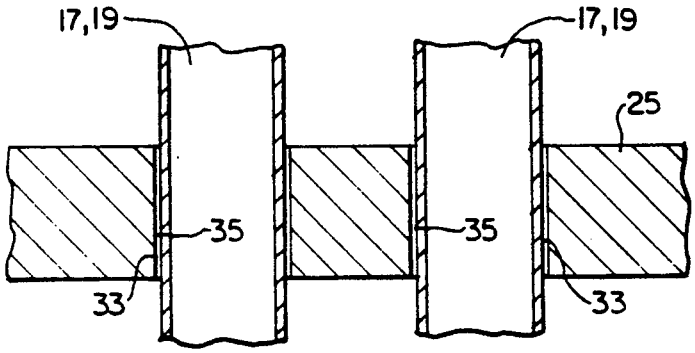
FIG. 3A is a cross sectional side view of a portion of a support plate and heat exchanger tubes as seen along line *3a*—*3a* of FIG. 3B.
Figure 3B:
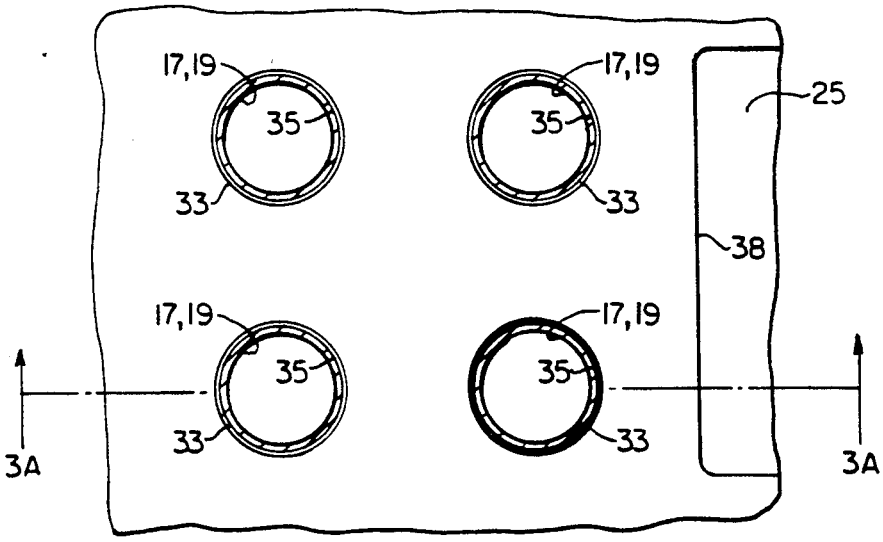
FIG. 3B is a plan view of a portion of a support plate showing a cross section of heat exchanger tubes passing therethrough.

FIG. 4 shows the zone of the heat exchanger 15 which is in the area of feed nozzle 36. In this area, the nonradioactive water circulating through the heat exchanger 15 will have a flow path which, at least in part, has a crosswise directional flow component relative to the cold legs 19 of the heat exchanger tubes 16 which are extending axially through the steam generator vessel formed by wrapper 29 and shell 31. Since, as shown in FIGS. 3A, 3B, the parallel heat exchanger tubes extend through the openings 33 of the support plates 25 with a tube-to-plate clearance gap 35 to facilitate manufacture of the heat exchanger, the cross flow components of the nonradioactive water flow can cause the leg 19 of the heat exchanger tubes to vibrate within the oversized openings 33 if no corrective action is taken. However, in accordance with the present invention, in any such zones where cross flow components can act on a portion of the heat exchanger tubes extending axially through the support plates, the conventional manner of constructing and mounting the support plates 25 is replaced with that in accordance with the present invention. While in a typical Westinghouse-type nuclear steam generator the only such zone will be in the area of the feed nozzle 36, extending above and below it to an extent that will depend on the specific design, and the support plates in the remaining area of the heat exchanger will be conventionally constructed and mounted, the construction and mounting techniques in accordance with the present invention may be applied to any point in any type of heat exchanger where cross flows will occur, by design or circumstance, and would result in undesirable vibration and wear.

More specifically, the present invention provides a means for applying a loading of the portion of the heat exchanger tubes that are subject to crosswise directional flow components which prevents them from vibrating. This loading is applied by causing alternate support plates to shift in opposite directions, transversely relative to the heat exchanger tubes, as the heat exchanger is brought up to operational temperatures and pressures when the steam generator is put into operation.

As can be seen in FIGS. 4 and 5, alternate support plates 25*a*, 25*b* have one end secured and one end free. In the case of the alternate plates 25*a*, the support plates are connected to the wall of the wrapper 29 while the end adjacent the central divider 27 is free of connection to the central divider plate. On the other hand, the alternate support plates 25*b* are connected to the central divider plate 27 with there being no connection between the wrapper 29 and the adjacent edge portion of the support plates 25*b*. In this regard, while an expansion gap 54, of approximately 0.5" (12.7 mm) is shown as existing between the free ends of the support plates 25*a*, 25*b* and the central divider plate 27 or the wrapper 29, including its preheater distribution box 37, respectively, the provision of such an expansion gap 54 is not essential to the practice of the present invention.

The connection of the support plates 25*a*, 25*b* to the central divider 27 or the wrapper 29 is preferably a bracket-type connection comprised of a plurality of hook-shaped mounting brackets 50, the free ends of which are received in elongated mounting slots 52. In the illustrated embodiment, the mounting brackets are shown attached to the central divider plate and the wrapper with the mounting slots being formed in the support plates 25*a*, 25*b*. However, this relationship can be reversed or other forms of attachment utilized so long as the form of the connection selected is capable of exerting a pulling force upon the support plates which will shift them toward the central divider plate or the wrapper. In this regard, it is noted that the connection between the support plates 25*a*, 25*b* and the respective one of the central divider plate and wrapper with which the connection is formed is not intended to replace the usual vertical support provided, for example, via stay rods and spacer pipes, and merely serves to produce a relative displacement that is derived from thermal motions of the support plates and thermal and pressure motion of the wrapper and distribution box. Once the magnitude of the relative displacement derived from these motions exceeds the magnitude of the tube-to-plate clearance gap 35, preloading forces are developed in the tubes. Since every other plate imposes an oppositely directed preloading force, a passive, positive tube support is generated when the unit is brought up to its operating temperatures and pressures. The magnitude of the preload forces can be adjusted through selection of the stiffness of the central divider plate, the diameter of the heat exchanger tubing and the tube support span within the range of such values that are standard in the industry.

As can be seen most clearly in FIG. 5, each of the elongated slots 52 has a length that is greater than the lateral width of the respective hook that is received in it. This permits lateral movement of the end of each mounting bracket 50 within the respective slot 52 so as not to affect other thermal expansions. Furthermore, while the width of the slots 52 can be set to produce a snug fitting of the mounting brackets 50, these slots can have a width that is greater than the thickness of the mounting brackets 50 so long as the slots are positioned so that the facing sides of the slot and bracket which must engage to produce a pulling effect on the plates. In FIG. 4, this means that the surface of the end of the brackets 50 that faces the central divider plate 27 would engage with the facing wall of the slots of plates 25*b*, and the side of the mounting brackets facing the wrapper 29 would engage the facing surface of the slots in plates 25*a* at ambient temperatures and pressures. Additionally, as shown in FIG. 5, the central divider plate can be keyed to shell 31 through the wrapper 29 and together with the selection of the points of attachment can serve to "tune" the motion connection for the support plates so as to obtain the desired stiffness for producing the above-noted relative displacement from the thermal motions of the support plates and thermal/pressure motion of the vessel walls and feed nozzle.

Since the secondary of a nuclear steam generator is typically built from the bottom up, the illustrated arrangement in which the hook-shaped mounting brackets 50 engage within the slots 52 from above makes it easier to add the brackets 50 after mounting of the plates 25 without influencing the positioning of the plates due to the provision of these mounting brackets. However, if other assembly techniques were to be used for construction of the heat exchanger, the hook-shaped brackets 50 could engage the slots 52 of the support plates 25 from below. Likewise, while the support plates 25 have been shown as being solid plates within which openings have been formed, they could be open flow supports of a grid-like construction or any other known support plate type. Similarly, the circulation path can be a vertical or axial flow through openings in the plates or can be a forced back-and-forth motion along the plates and through cut-out openings in them. Thus, the concepts of the present invention are generically applicable to any and all types of heat exchanger flow paths used in heat exchangers of the general type composed of a plurality of parallel heat exchanger tubes mounted extending through a plurality of support plates within a vessel.

In view of the foregoing, it should now be apparent that the present invention is susceptible to numerous permutations, modifications and embodiments beyond that disclosed herein so that the present invention should not be viewed as limited to the specific embodiment disclosed herein, and, instead, it is intended to encompass the full scope of the appended claims.

I claim:

1. Heat exchanger of the type having a vessel within which a plurality of parallel heat exchanger tubes are mounted extending through a plurality of support plates with clearance, said support plates extending transversely across the heat exchanger vessel, and means for feeding a fluid, which is to be heated by heat transferred from a heat exchange medium circulating through the heat exchanger tubes, into the vessel in a manner causing the fluid to have a flow path which, at least in part, has a crosswise directional flow component relative to a portion of the heat exchanger tubes extending axially through the vessel; the improvement comprising means for causing alternate ones of said support plates, in a zone containing said part of the flow path having a crosswise directional flow component, to shift in opposite directions transversely relative to said portion of the heat exchanger tubes, as said heat exchanger is brought up to operating temperatures and pressures, in a manner applying a loading on said portion of the heat exchanger tubes which will prevent them from vibrating due to the crosswise directional flow component of said fluid; wherein support plates outside of said zone are free of securement relative to both the central divider plate and the wall of the vessel.

2. Heat exchanger of the type having a vessel within which a plurality of parallel heat exchanger tubes are mounted extending through a plurality of support plates with clearance, said support plates extending transversely across the heat exchanger vessel, and means for feeding a fluid, which is to be heated by heat transferred from a heat exchange medium circulating through the heat exchanger tubes, into the vessel in a manner causing the fluid to have a flow path which, at least in part, has a crosswise directional flow component relative to a portion of the heat exchanger tubes extending axially through the vessel; the improvement comprising means for causing alternate ones of said support plates, in a zone containing said part of the flow path having a crosswise directional flow component, to shift in opposite directions transversely relative to said portion of the heat exchanger tubes, as said heat exchanger is brought up to operating temperatures and pressures, in a manner applying a loading on said portion of the heat exchanger tubes which will prevent them from vibrating due to the crosswise directional flow component of said fluid; wherein the support plates in said zone extend between a central divider plate and a wall of the vessel, said alternate ones of said support plates being alternately connected on one of said central plate and said wall of the vessel and being free of connection to the other of the said central divider plate and said wall of the vessel.

3. Heat exchanger according to claim 2, wherein the connection of the alternate ones of said support plates to one of the central divider and the wall of the vessel comprise a plurality of hook and slot connections, each of which has a hook in pulling contact with a wall of a slot.

4. Heat exchanger according to claim 3, wherein the slot of each hook and slot connection is formed in a respective support plate, and the hook is mounted on the respective one of the central divider plate and the wall of the vessel.

5. Heat exchanger according to claim 4, wherein each slot has a length that is greater than a lateral width of the respective hook received therein for permitting lateral movement of the hook within the respective slot.

6. Heat exchanger according to claim 5, wherein said portion of the heat exchanger tubes is vertically oriented and the support plates are horizontally oriented; and wherein said hooks engage in said slots from above.

7. Heat exchanger according to claim 3, wherein said portion of the heat exchanger tubes is vertically oriented and the support plates are horizontally oriented; and wherein said hooks engage in said slots from above.

8. Nuclear steam generator of the type with a heat exchanger in a secondary side of a vessel having a wrapper within a shell, a plurality of parallel heat exchanger tubes mounted extending through a plurality of support plates with clearance, said support plates extending transversely across the vessel, and means for feeding nonradioactive water, which is to be heated by heat transferred from a radioactive heat exchange medium circulating through the heat exchanger tubes, into the vessel in a manner causing the nonradioactive water to have a flow path which, at least in part, has a crosswise directional flow component relative to a portion of the heat exchanger tubes extending axially through the vessel; the improvement comprising means for causing alternate ones of said support plates, in a zone containing said part of the flow path having a crosswise directional flow component, to shift in opposite directions transversely relative to said portion of the heat exchanger tubes, as said steam generator heat exchanger is brought up to operating temperatures and pressures, in a manner applying a loading on said portion of the heat exchanger tubes which will prevent them from vibrating due to the crosswise directional flow component of said fluid; wherein support plates outside of said zone are free of securement relative to both the central divider plate and the wrapper.

9. Nuclear steam generator of the type with a heat exchanger in a secondary side of a vessel having a wrapper within a shell, a plurality of parallel heat exchanger tubes mounted extending through a plurality of support plates with clearance, said support plates extending transversely across the vessel, and means for feeding nonradioactive water, which is to be heated by heat transferred from a radioactive heat exchange medium circulating through the heat exchanger tubes, into the vessel in a manner causing the nonradioactive water to have a flow path which, at least in part, has a crosswise directional flow component relative to a portion of the heat exchanger tubes extending axially through the vessel; the improvement comprising means for causing alternate ones of said support plates, in a zone containing said part of the flow path having a crosswise directional flow component, to shift in opposite directions transversely relative to said portion of the heat exchanger tubes, as said steam generator heat exchanger is brought up to operating temperatures and pressures, in a manner applying a loading on said portion of the heat exchanger tubes which will prevent them from vibrating due to the crosswise directional flow component of said fluid; wherein the support plates in said zone extend between a central plate and the wrapper of the vessel, said alternate ones of said support plates being alternately connected to one of said central divider plate and said wrapper, and being free of connection to the other of the said central divider plate and said wrapper.

10. Nuclear steam generator according to claim 9, wherein the connection of the alternate ones of said support plates to one of the central divider and the wrapper of the vessel comprise a plurality of hook and slot connections, each of which has a hook in pulling contact with a wall of a slot.

11. Nuclear steam generator according to claim 10, wherein the slot of each hook and slot connection is formed in a respective support plate, and the hook is mounted on the respective one of the central divider plate and the wrapper of the vessel.

12. Nuclear steam generator according to claim 11, wherein each slot has a length that is greater than a lateral width of the respective hook received therein for permitting lateral movement of the hook within the respective slot.

13. Nuclear steam generator according to claim 12, wherein said portion of the heat exchanger tubes is vertically oriented and the support plates are horizontally oriented; and wherein said hooks engage in said slots from above.

14. Nuclear steam generator according to claim 10, wherein said portion of the heat exchanger tubes is vertically oriented and the support plates are horizontally oriented; and wherein said hooks engage in said slots from above.

15. Method of eliminating heat exchanger tube vibration resulting from cross-flows in a heat exchanger of a nuclear steam generator of the type wherein the heat exchanger is located in a secondary side of a vessel having a wrapper within a shell, a plurality of parallel heat exchanger tubes mounted extending through a plurality of support plates with clearance, said support plates extending transversely across the vessel, and nonradioactive water, which is to be heated by heat transferred from a radioactive heat exchange medium circulating through the heat exchanger tubes, is fed into the vessel in a manner causing the nonradioactive water to have a flow path which, at least in part, has a crosswise directional flow component relative to a portion of the heat exchanger tubes extending axially through the vessel; comprising the step of causing alternate ones of said support plates, in a zone containing said part of the flow path having a crosswise directional flow component, to shift in opposite directions transversely relative to said portion of the heat exchanger tubes, as said steam generator heat exchanger is brought up to operating temperatures and pressures, in a manner applying a loading on said portion of the heat exchanger tubes which will prevent them from vibrating due to the crosswise directional flow component of said fluid; wherein said step of causing the alternate ones of said support plates to shift is performed by the support plates in said zone extending between a central divider plate and the wrapper of the vessel, said alternate ones of said support plates being alternately connected to one of said central divider plate and said wrapper, and being free of connection to the other of the said central divider plate and said wrapper, so that a pulling force is exerted on each plate in a direction toward its connection to the respective one of the central divider plate and the wrapper.

16. Method according to claim 15, wherein the pulling force is exerted by a plurality of hook and slot connections, each of which has a hook in pulling contact with a wall of a slot.

17. Method according to claim 15, wherein the loading on said portion of the heat exchanger tubes which will prevent them from vibrating due to the crosswise directional flow component of said fluid is applied by bringing the alternate support plates into engagement with opposite sides of the heat exchanger tubes to provide a passive, positive supporting of the heat exchanger tubes by the supporting plates under operating temperatures and pressures despite the existence of clearance gaps between the heat exchanger tubes and the support plates through which they pass.

* * * * *